United States Patent [19]

Chan et al.

[11] 4,088,530

[45] May 9, 1978

[54] DRY STRENGTH PAPER AND PROCESS THEREFOR

[75] Inventors: Lock-Lim Chan, Whitby; Joseph Francis Schaffer, Toronto, both of Canada

[73] Assignee: Borden Products Limited, West Hill, Canada

[21] Appl. No.: 683,581

[22] Filed: May 6, 1976

Related U.S. Application Data

[63] Continuation of Ser. No. 537,252, Dec. 30, 1974, abandoned.

[30] Foreign Application Priority Data

Nov. 5, 1974 Canada ..... 213060

[51] Int. Cl.[2] ..... D21H 3/48

[52] U.S. Cl. ..... 162/168 NA; 162/181 A

[58] Field of Search ..... 162/168 R, 168 NA, 181 A; 526/303, 317

[56] References Cited

U.S. PATENT DOCUMENTS

| | | | |
|---|---|---|---|
| 3,049,469 | 8/1962 | Davison | 162/164 |
| 3,269,891 | 8/1966 | Reynolds et al. | 162/164 |
| 3,332,834 | 7/1967 | Reynolds | 162/164 |

FOREIGN PATENT DOCUMENTS

| | | | |
|---|---|---|---|
| 826,107 | 10/1969 | Canada. | |
| 41,609 | 12/1970 | Japan | 162/168 |

*Primary Examiner*—S. Leon Bashore
*Assistant Examiner*—William F. Smith
*Attorney, Agent, or Firm*—George A. Kap; George P. Maskas; Daniel D. Mast

[57] ABSTRACT

Paper of dry strength is produced by forming an aqueous solution of papermaking cellulose fibers and adding thereto a 90:10 to 98:2 copolymer of acrylamide and maleic acid followed by addition of alum. The use of the acrylamide-maleic acid copolymer allows production of paper at a much broader pH range towards the alkaline side which eliminates the need for close control of pH and which substantially reduces corrosion of the papermaking equipment.

10 Claims, No Drawings

DRY STRENGTH PAPER AND PROCESS THEREFOR

This is a continuation of application Ser. No. 537,252, filed Dec. 30, 1974, now abandoned.

The present invention relates to paper having dry strength and process for its manufacture which is characterized by the use of an anionic resin which is a copolymer of acrylamide and maleic acid together with alum or another suitable metallic polyvalent salt. The copolymer of acrylamide and maleic acid is a dry strength additive which imparts a negligible amount of wet strength to the paper thus facilitating repulping thereof or making such paper available for particular applications where dry strength must predominate.

U.S. Pat. No. 2,884,057 defines dry strength of paper as paper which has a dry strength of about 10% in excess of its normal strength as a result of resin treatment and such paper is generally regarded as possessing a materially improved dry strength.

The art of making dry strength paper dates back to at least 1951 when the Azorlosa Canadian Pat. No. 477,265 issued. This patent discloses the use of a copolymer of acrylamide with acrylic or methacrylic acids together with alum. Pursuant to the Azorlosa's patent, paper of improved dry strength is manufactured by forming an aqueous suspension of cellulose papermaking fibers, adding thereto the anionic dry strength resin which is a copolymer of acrylamide with acrylic or methacrylic acids as well as alum, and sheeting the suspension. The resulting paper possesses much better dry strength than normal paper and possesses virtually no wet strength so that it can be easily repulped.

It is a disadvantage of the process, however, that the paper is produced at the normal pH of alum solution, about 4.5. Paper produced at pH of 4.5 is significantly acid and undergoes acid tendering on aging. Moreover, paper-making systems operating at that pH impart a significant amount of corrosion to the apparatus under conditions of constant use. As a result, efforts have been made to discover means for increasing the operating pH of paper-making systems producing dry strength paper of the type just described without sacrifice of the dry strength developed by the resin.

With the exceptions described in the herein-noted prior art, it has not been possible to increase the system pH beyond about 4.7–4.8 as the addition of alkali to give a higher pH causes the strengthening effect of the resin to disappear abruptly. Repeated laboratory tests have shown that the resin to cellulose bond is weak when formed at pH values in excess of about 4.7.

The close control of pH has been obviated by the invention described herein which allows manufacture of dry strength paper in a pH range of 4.5 to 6.5 without weakening the resin to cellulose bond. This has been accomplished by the use of anionic copolymer of acrylamide and maleic acid in conjunction with alum which fixes the copolymer to the fibers. The unexpected advantage of this invention is achieved if the resin is added to the paper fiber suspension before addition of alum.

The prior art describes manufacture of paper having substantial dry strength and negligible wet strength. The Azorlosa Canadian patent has already been mentioned. This patent describes and claims the use of a copolymer of acrylamide or methacrylamide with acrylic or methacrylic acids followed by addition of alum to the aqueous suspension. In view of the fact that the acrylic acids described in the Azorlosa patent are structurally similar to maleic acid in that they contain a vinyl group and one carboxyl group, as illustrated below:

| $CH_2 = CR - COOH$ acrylic type acid | $HOOC - CH = CH - COOH$ maleic acid |
|---|---|

one might be tempted to conclude that substitution of such acids as itaconic, maleic and fumaric for the acrylic type acid would be obvious especially in view of the known fact that such acids are known to copolymerize with acrylamide. Such a conclusion of obviousness would be unfounded since no attempt has been made to study the effect of a dual carboxy moiety on dry and wet strength of paper. The advantage achieved by the use of the acrylamide-maleic acid copolymer is unexpected since it allows pH in the paper-making system to vary over a range from 4.5 to 6.5 without detriment to the dry strength of paper. To put importance of this two-point spread in perspective, attention is directed to lines 54 to 57 in col. 1 of the Reynolds et al. U.S. Pat. No. 3,269,891 where it is noted that the invention described therein permits the pH in the papermaking system to be increased by half of a pH unit.

With respect to the Azorlosa patent, it is here pointed out that a minor amount of polyacrylamide can be hydrolyzed to yield carboxyl groups which would make it resemble a polyacrylamide—co-acrylic acid. However, under our polymerization conditions, the amount of carboxylic acid groups produced by hydrolysis should be no more than about 1%. Amount of acrylic acid used in Azorlosa copolymer is between 1 and 25%, preferably 5 to 12%, whereas amount of maleic acid used in the acrylamide-maleic acid copolymer of our invention is from 3 to 15%, preferably from 5 to 10%. Amounts here given are based on the total weight of the monomers. Therefore, even if there were a minor amount of hydrolyzed acrylamide in the acrylamide-acrylic acid copolymer of the Azorlosa's patent, this amount would be insignificant for the purpose described herein.

The principal discovery in the Reynolds et al U.S. Pat. No. 3,269,891 relates to the use of a buffer to fix the anionic dry strength resin. As far as the anionic dry strength resin is concerned, Reynolds et al did not disclose any novel polymer other than a generalization of what has been reported in Azorlosa's Canadian Pat. No. 477,265. Reynolds et al. demonstrated that the use of Azorlosa's anionic polymer fixed on the fiber with alum to confer dry strength required a carefully controlled pH of about 4.5 and the addition of alkali to give a pH higher than 4.7–4.8 caused the strengthening effect of the resin to disappear abruptly. Reynolds et al's invention relates to the manufacture of paper of improved dry strength by use of an anionic polymer fixed on the fiber with alum in the presence of a buffer so that the resin retains its high efficiency up to a pH of about 5.5 so that accurate control of pH is no longer necessary. The buffer is a non-chelating acid having an ionization constant between $10^{-4}$ and $10^{-6}$ and a salt of such acid with a strong base.

Davison Pat. No. 3,049,469 discloses a process for making paper having wet and dry strength by impregnating cellulosic fibers disposed in an aqueous suspension first with a cationic thermosetting polyamide-epichlorohydrin resin and then with an acrylic resin. Davison's objectives are achieved without the use of alum.

Our method for manufacturing paper of high dry strength but of low wet strength includes forming an aqueous suspension of cellulose papermaking fibers and adding thereto an aqueous solution of acrylamide-maleic acid resin followed by addition of alum or another polyvalent metallic salt. Amount of the resin used may vary from 0.1 to 2.0% depending on the required dry strength and the type of papermaking system whereas amount of the alum used is in the range of 1 to 3%. Amount of alum less than 1% or more than 3% generally have an adverse effect on efficiency of the dry strength resin. Amounts are given on the basis of dry weight of the fibers. The resin and alum are used in ½ to 5% aqueous solutions. The reagents may be added at any convenient point in the papermaking system. In practice, the resin is most advantageously added to the paper-making fibrous suspension in the beater and the alum is most advantageously added as near to the wire as possible, for example at the fan pump, sufficient time being preferably allowed in each instance for the added reagent to become uniformly distributed through the suspension before the next reagent is added.

The mol ratio of acrylamide to maleic acid in the copolymer is in the range of from 90:10 to 98:2, preferably 95:5. The resin suitable for our purpose has molecular weight, as represented by intrinsic viscosity (measured in 0.1 N NaCl solution at 25° C) in the range of from 0.5 dl/g to 6.0 dl/g, preferably from 1.0 dl/g to 1.5 dl/g. In place of alum, other polyvalent metallic salts can be used such as aluminum chloride or aluminum nitrate.

Our process has the advantage over the prior art in that a specific resin can be used in a much wider pH range of 4.5 to 6.5 than was hitherto possible which obviates the necessity for close pH control. Furthermore, the use of a third component such as a thermosetting or nonthermosetting polyamide, or the use of a buffer, is not necessary. The application of the acrylamide-maleic acid copolymer as a dry strength additive is preferably carried out by adding the polymer at a suitable point to the paper stock after completion of major refining. Sufficient alum must be added after the addition of the resin in order to fix the resin onto the fibers. The adjustment of pH can be made after all these additions have been completed if a certain pH value is desired. When the resin and alum are added in this preferred order, the efficiency of the resin to strengthen paper is not adversely affected by a pH change in the range of 4.5 to 6.5. If the alum is added before the resin, efficiency of the resin will be more affected by the change of pH.

Outline of the preparation of a 95.5 mol ratio acrylamide-maleic acid copolymer is given below:

| | Reactants | % by weight |
|---|---|---|
| 1A | Water (heel) | 43.00 |
| 1B | Sequestrene NA-22 | 0.01* |
| 2 | Water | 20.00 |
| 3 | Acrylamide | 18.51 |
| 4 | Water (at 130–140° F or 55–60° C) | 8.27 |
| 5 | Maleic anhydride | 1.35 |
| 6 | Ammonia solution 26° Be | 0.75 |
| 7 | Water | 4.80 |
| 8 | Potassium Persulfate | 0.06 |
| 9 | Water | 3.20 |
| 10 | Potassium Persulfate | 0.05 |
| | | 100.00% |

*The amount of Sequestrene NA-22 used is generally less than 0.01% and is preferably about 0.005%.

Procedure:

(A) Charge reactor with (1A) and (1B). Set reflux to full return and heat to reflux.

(B) Prepare a solution by dissolving (3) in (2) in a container of suitable volume.

(C) Prepare a solution by dissolving (5) in hot water (4) in a lined container.

(D) Make up the monomer mixture by adding solution (C) to solution (B).

(E) Add (6) to monomer mixture (D) in small increments while mixing and measuring the pH so that it can be adjusted to pH of 3.0. Record the final pH.

(F) Prepare the catalyst solution by dissolving (8) in (7) in a lined container.

(G) If the heel temperature reaches 212° F or 100° C, start feeding the monomer mixture (D-E) and initiator (F). Feeding should be completed in 90 minutes and reflux must be maintained. If reaction mixture cools below boiling point and stops, reflux of monomer and catalyst feeds must be halted until reflux is restored. Measure and record the Brookfield viscosity in every 15 minutes using the LVF 4 spindle at 95° C (203° F).

(H) When two-thirds of the monomer and initiator is fed into the reactor, prepare the booster initiator solution by dissolving (10) in (9) in a lined container that was used to prepare (F).

(I) When monomer and initiator feeding is completed, start feeding the booster catalyst. Feeding should be completed in 60 minutes under refluxing. When completed, measure and record viscosity under conditions described in (G).

(J) When feeding the booster catalyst is complete, maintain reactor at reflux for an additional 3 hour period. Continue measuring the viscosity every hour.

(K) Cool resin to 100° F or 40° C, take a one quart sample and drum off. Measure the pH and Brookfield viscosity of the product at 25° C (77° F).

The final product should have the following properties:

solids; 20% + 1% viscosity; 400 to 800 cps. (Brookfield LVF, Spindle #4, at 30 rpm, 90° C), or 1000 to 2000 cps (Brookfield, Spindle #4, at 12 rpm, 25° )

pH; 4.8 to 5.4

Wt. per gal., 25° C; 10.75 (Imperial gallon) or 8.96 (U.S. gallon).

Our invention will now be more particularly described with reference to the following examples which constitute specific embodiments and are not to be construed as limitations thereof. Unless otherwise stated, percentages are based on the dry weight of the fibers.

EXAMPLE 1

Copolymerization of Acrylamide and Maleic Acid, 95:5 mol ratio 3.4 grams of maleic anhydride were dissolved in 50 ml of distilled water (Solution A); and 46.6 grams of purified acrylamide were dissolved in 400 grams of distilled water (Solution B). Solution (A) was added to Solution (B) to form Solution (C); the pH after mixing was 2.30. This mixture, Solution (C), was degassed and placed in a one liter, 3-necked flask equipped with a stirrer, a nitrogen inlet, a thermometer, a sampling device and a reflux condenser. After nitrogen was bubbled through this mixture for 15 minutes and the Solution (C)

was cooled to 10° C, an initiator mixture containing 0.01 grams of ammonium persulfate, and 0.004 grams of $(NH_4)_2SO_4FeSO_4.6H_2O$ was charged. The solution was held at 14° to 18° C until it reached a Brookfield viscosity of 65,000 (LVF Spindle #4, 6 rpm, at 20° C) and sufficient water was added to dilute the solution to about 5% solids. Additional initiator containing 0.1 gram of ammonium persulfate and 0.04 gram of $(NH_4)_2SO_4FeSO_4.6H_2O$ was charged. The solution was then heated to about 70° C and held there for 1 hour.

The product had the following properties:

pH; 2.30 solids; 5.21% % viscosity; 62,000 cps. (Brookfield LVF, 4/6 rpm, 20° C).

Effectiveness of this resin as a dry strength additive to paper remained unchanged over a pH range of 4.5 to 6.5

EXAMPLE 2

Copolymerization of Acrylamide-Acrylic Acid, 90:10 Mol Ratio

In a reactor similar to Example 1, a monomer mixture containing 622.0 grams of acrylamide, 54.8 grams of acrylic acid, 168.4 grams of 10% NaOH and 182 grams of water was allowed to react with a catalyst mixture containing 1.3 grams of ammonium persulfate in 198 grams of water at refluxing temperature. Water was used as a solvent in amount of 1934.0 grams The product had the following properties:

solids; 15.8% viscosity; 8,300 cps. (Brookfield LVF Spindle No. 4 at 12 rpm, 25° C).

Effectiveness of this resin as a dry strength additive to paper dropped substantially at pH higher than about 4.5.

EXAMPLE 3

Preparation of Acrylic Acid-Acrylamide Copolymer according to Canadian Pat. No. 477,265

An acrylamide-acrylic acid copolymer was prepared according to Canadian Pat. No. 477,265 and different from feeding procedure described in Example 2. Thus, 45.0 grams of acrylamide and 5.1 grams of acrylic acid were dissolved in 2,450 grams of distilled water. 0.5 grams of potassium persulfate were added to the solution which was then degassed under vacuum and allowed to stand in the absence of air for 7 days at room temperature.

The product had the following properties:

solids; 2.53% viscosity; 1,780 cps. (Brookfield LVF, Spindle No. 4 at 60 rpm, 25° C)

pH; 3.4.

EXAMPLE 4

Evaluation of Dry Strength Additive

The effect of additive on the strength of paper can be evaluated generally according to the following procedure. A chosen pulp at 1.6% consistency was beaten to a desired Canadian Standard Freeness. This slurry was diluted to a consistency of 0.25% and the pH was adjusted to the desired value with N/1 aqueous solution of either sulfuric acid or sodium hydroxide.

To 1 liter aliquot of stock slurry, 2.0 ml of a 0.625% resin solution was added and mixed for 1 minute. While mixing, 10.0 ml of a 0.75% aqueous solution of alum was added and the pH was adjusted to the desired value while continuing mixing for 4 more minutes. This slurry was emptied into a Williams sheet mold previously filled to about ¾ full with water and the water was drained. The wet handsheet, while still resting on the screen, was covered with a blotter (supplied by Domtar Pulp and Paper Company and fitted Tappi specification) and then placed in a Williams sheet press for 1–2 seconds at 10–20 psi pressure. The handsheet adhering to the blotter was removed from the press and screen and was then covered with another blotter and pressed in the Williams Sheet Press for 3 minutes at 100 psi. After pressing, the sheet, together with the original blotter, was dried in an Emerson Speed drier (model 10) for 3 minutes at 240° F with the blotter side up.

The sheet was then conditioned at room temperature and about 50% humidity overnight.

The paper sheet was cut into 15 mm wide strips with a Thwing-Albert JDC-15 sample cutter, and tested on a Thwing-Albert Electro-Hydraulic tensile tester. Average of nine tests was reported for tensile test.

Bursting strength was tested by the use of a B. F. Perkins hand-driven Mullen Tester and an average of 18 values was reported.

An example of a hardwood bleached sulfite pulp prepared pursuant to this invention is as follows:

Furnish: Weyerhauser Hardwood Bleached Sulfite

C.S.F.: 560 ml

Resin Level: 0.5%

Alum: 3.0%

Order of Addition: resin, alum and pH adjustment with dilute sulfuric acid or sodium hydroxide solution.

The following results were obtained:

| | Dry Tensile (lb/15mm) | | |
|---|---|---|---|
| Resin/pH | 7.0 | 6.0 | 4.5 |
| Control (1) | 3.52 | 3.92 | 3.77 |
| Acrylamide-maleic acid (Ex. 1) | 5.87 | 6.02 | 5.12 |
| Acrylamide-acrylic acid (Ex. 2) | 5.25 | 5.33 | 6.16 |

| | Mullen (psi) | | |
|---|---|---|---|
| Resin/pH | 7.0 | 6.0 | 4.5 |
| Control | 2.47 | 2.82 | 2.65 |
| Acrylamide-maleic acid (Ex. 1) | 8.42 | 8.56 | 6.64 |
| Acrylamide-acrylic acid (Ex. 2) | 5.22 | 5.57 | 8.98 |

(1) Paper without the treatment with resin or alum.

The above results unequivocally illustrate the advantage which is obtained by the use of acrylamide-maleic acid copolymer in the manufacture of paper as opposed to an acrylamide-acrylic acid copolymer. The tensile strength for our resin actually increased considerably from 5.12 at pH of 4.5 to 6.02 at pH of 6.0 and then declined to 5.87 at pH of 7.0. With the acrylamide-acid copolymer, the tensile strength declined from 6.16 at pH of 4.5 to 5.33 at pH of 6.0 and further to 5.25 at pH of 7.0. The effect of the pH on the bursting strength was even more impressive, as the above-tabulated results indicate.

EXAMPLE 5

Further tests were conducted to determine burst strength and tensile strength of paper containing the resins prepared in Examples 1 and 3 as well as on paper made without any resin or alum and paper made without resin but with alum. The procedure followed and amounts of ingredients are set forth in Example 3. The results, set forth below, confirm conclusions made earlier.

| Resin/pH | Burst Strength (psi) 4.0 | 4.5 | 5.0 | 5.5 | 6.5 |
|---|---|---|---|---|---|
| Control (1) | 7.23 | 7.82 | 7.22 | 7.60 | 8.0 |
| Alum (2) | 8.53 | 8.74 | 9.42 | 9.82 | 10.78 |
| Ex. 3 | 16.82 | 14.0 | 13.99 | 13.24 | 13.10 |
| Ex. 1 | 17.52 | 19.91 | 21.26 | 18.84 | 18.96 |

| Resin/pH | Tensile Strength (lb/15mm) 4.0 | 4.5 | 5.0 | 5.5 | 6.5 |
|---|---|---|---|---|---|
| Control (1) | 5.60 | 5.90 | 5.90 | 5.60 | 5.90 |
| Alum (2) | 6.00 | 6.10 | 6.30 | 6.40 | 6.80 |
| Ex. 3 | 8.2 | 7.5 | 7.5 | 7.0 | 7.37 |
| Ex. 1 | 8.51 | 9.16 | 9.22 | 9.10 | 8.83 |

(1) Paper without the treatment with resin or alum
(2) Paper treated with 3% alum but no resin.

What we claim is:

1. Process for the manufacture of paper of improved dry strength and negligible wet strength without the use of a buffer and without a water-soluble non-thermosetting cationic resin comprising the steps of forming an aqueous suspension at pH of about 5 to 7 of paper making fibers containing a dry strength additive and a fixing agent selected from the group consisting of polyvalent metal salts and mixtures thereof, and sheeting the suspension to form the paper, the additive consisting essentially of a copolymer of acrylamide and maleic acid or its anhydride in respective mol ratio of from 90:10 to 98:2 which is used in sufficient amount to impart to the paper improved dry strength and negligible wet strength whereas the salt is used in sufficient amount to affix the copolymer to the fibers.

2. Process of claim 1 including the step of first adding the copolymer to the suspension with mixing followed by the step of adding the salt which is selected from the group consisting of alum, aluminum chloride, aluminum nitrate and mixtures thereof; amount of the copolymer being from 0.1 to 2% and amount of the salt being from 1 to 3%, both amounts are based on the weight of dry fibers.

3. Process of claim 2 wherein the salt is alum, the copolymer has an intrinsic viscosity of from 0.5 to 6 dl/g measured in a 0.1N NaCl solution at 25° C and the suspension has a pH in the range of up to 6.5.

4. Process of claim 3 wherein the copolymer and the salt are in 0.5 to 5% solids aqueous solutions when added to the suspension, the copolymer solution being acidic.

5. Process of claim 2 wherein mol ratio of acrylamide to maleic acid or its anhydride in the copolymer is about 95:5.

6. Process of claim 2 wherein pH of the suspension is in the range of up to 6.5.

7. Paper composed of cellulose fibers and being devoid of a buffer and a water-soluble non-thermosetting cationic resin having deposited thereon a fixing agent selected from the group consisting of polyvalent metal salts and being bonded with a dry strength additive consisting essentially of a copolymer of acrylamide and maleic acid or its anhydride in respective mol ratio of from 90:10 to 98:2 which is used in sufficient amount to impart to the paper improved dry strength and negligible wet strength whereas the salt is used in sufficient amount to affix the copolymer to the fibers.

8. Paper of claim 7 wherein the salt is selected from the group consisting of alum, aluminum chloride, aluminum nitrate and mixtures thereof, amount of the copolymer is from 0.1 to 2% and amount of the salt is from 1 to 3%, both amounts being based on the weight of dry fibers.

9. Paper of claim 8 wherein the salt is alum and the copolymer has an intrinsic viscosity of from 0.5 to 6 dl/g measured in a 0.1 N NaCl solution at 25° C.

10. Paper of claim 9 wherein mol ratio of acrylamide to maleic acid or its anhydride is about 95:5.

* * * * *